US006669195B1

(12) United States Patent
Gordon

(10) Patent No.: US 6,669,195 B1
(45) Date of Patent: Dec. 30, 2003

(54) MAGNETIC GAMING DEVICE HAVING PREDETERMINED OUTCOMES WHICH APPEAR TO BE RANDOM

(76) Inventor: Stephen E. Gordon, 9429 Silvaner Ct., Las Vegas, NV (US) 89123

( * ) Notice: Subject to any disclaimer, the term of this patent is extended or adjusted under 35 U.S.C. 154(b) by 0 days.

(21) Appl. No.: 10/243,507

(22) Filed: Sep. 13, 2002

(51) Int. Cl.[7] ..... A63F 7/02

(52) U.S. Cl. ..... 273/121 B; 273/123 A; 273/138.3

(58) Field of Search ..... 273/118 A, 120 A, 273/121 A, 121 B, 123 A, 126 A, 138.3, 443

(56) References Cited

U.S. PATENT DOCUMENTS

| | | | | | |
|---|---|---|---|---|---|
| 492,178 | A | | 2/1893 | Young | |
| 641,861 | A | | 1/1900 | Huestis | |
| 2,184,867 | A | * | 12/1939 | Williams et al. | 273/119 A |
| 2,731,266 | A | * | 1/1956 | Neilson | 273/121 A |
| 2,986,397 | A | | 5/1961 | Cusano et al. | |
| 3,090,622 | A | | 5/1963 | Sire | |
| 3,721,445 | A | | 3/1973 | McNaney | |
| 3,764,144 | A | * | 10/1973 | Arthur | 273/126 A |
| 3,834,707 | A | | 9/1974 | Birkett | |
| 4,043,558 | A | * | 8/1977 | Star | 273/110 |
| 4,192,508 | A | * | 3/1980 | Livick | 273/118 A |
| 4,200,289 | A | | 4/1980 | Bosley | |
| 4,373,725 | A | | 2/1983 | Ritchie | |
| 4,601,470 | A | | 7/1986 | Kadota et al. | |
| 5,016,879 | A | | 5/1991 | Parker et al. | |
| 5,039,099 | A | | 8/1991 | Bravo | |
| 5,060,947 | A | | 10/1991 | Hall | |
| 5,082,274 | A | | 1/1992 | Bright | |
| 5,301,942 | A | | 4/1994 | Lacrosse | |
| 5,375,829 | A | * | 12/1994 | Lawlor et al. | 273/123 A |
| 5,664,775 | A | * | 9/1997 | Kao | 273/121 B |
| 5,697,611 | A | | 12/1997 | Kelly et al. | |

* cited by examiner

*Primary Examiner*—Raleigh W. Chiu
(74) *Attorney, Agent, or Firm*—Rob L. Phillips; Quirk & Tratos

(57) ABSTRACT

A pachinko-style game wherein one or more game pieces are invisibly directed to traverse a predetermined winning or non-winning path. Unlike traditional random pachinko games, the present invention only appears to be random. By strategically subjecting a magnetic game piece to magnetic forces, the game piece can be controlled such that a prize award is known prior to releasing the game piece into a field of game barriers. Translatable magnets adjacent an underside of a game surface allow an unlimited number of paths to be created by raising and lowering alternate magnets in different combinations. In the manner described, the results of the present invention may be regulated and therefore placed into casino environments.

35 Claims, 5 Drawing Sheets

MAGNETIC GAMING DEVICE HAVING PREDETERMINED OUTCOMES WHICH APPEAR TO BE RANDOM

FIELD OF INVENTION

The present invention relates generally to a method of predetermining the results of maze-type games, including pachinko and pinball, while retaining the appearance of complete randomness. More particularly, magnetic forces allow a game operator to predefine a path that one or more game pieces will travel thereby allowing exact win/loss percentages to be calculated in advance of game play. Based on the ability to predefine win/loss percentages, the present invention may be used as a primary or secondary gaming machine or as an amusement type game.

DESCRIPTION OF THE PRIOR ART

With the proliferation of gambling in the United States and foreign jurisdictions, there is an increased desire for the creation of new entertaining games. Over the years pachinko has been a popular wagering and amusement game. Pachinko involves dropping a ball into an at least partially vertical playing surface having pins extending therefrom. The pins alter the path of the ball until the ball eventually falls into one of a plurality of slots at the bottom of the playing surface. The slots have assigned values indicating what a player has won when a ball falls into that particular slot. If practiced correctly, conventional pachinko game outcomes are random and odds can be calculated from standard distribution and/or long trials.

By way of example, U.S. Pat. No. 5,016,879 (the '879 Patent) describes a plurality of pachinko mazes arranged side-by-side to be played in a manner associated with a typical slot machine. To that end, a disc or the like is dropped into each of three side-by-side pachinko mazes wherein the slots are each assigned a particular gaming indicia (i.e. plums, cherries, oranges). A player is then paid according to a pay table based on the three indicia outcome.

U.S. Pat. No. 5,301,942 (the '942 Patent) describes a game similar to pachinko. However, rather than a plurality of slots at the bottom of the playing surface, a coin rest pedestal is placed upon which a coin must rest in order to win the game. In addition, the game is watertight to allow it to be filled with fluid to further alter the path of a dropped coin.

As with all pachinko games, the '879 and '942 Patents disclose games with random outcomes. The present invention introduces certainty into such a random system. Magnets are the invisible force behind creating the certainty of the present invention. The prior art includes games utilizing magnets to alter the direction of gaming pieces.

For example, U.S. Pat. No. 5,039,099 (the '099 Patent) describes a square table game having pockets in each corner. The object of the game is to direct the game chips into the pockets by utilizing a larger primary chip. To increase the difficulty of the game, each chip is fashioned with opposing magnets on upper surfaces thereof. Therefore, certain first game chips repel certain second game chips thereby increasing the difficulty of maneuvering the chips into the pockets.

Certainly magnets may be used to increase the level of difficulty but the prior art fails to suggest or teach a method of predetermining the outcome of a game with magnetic forces. An object of the present invention is to fill the void in the prior art by using magnetic forces to direct one or more game pieces to a final location. Moreover, the predetermined outcome must appear to be random. Although various maze type games may practice the present invention, pachinko provides an ideal vehicle for describing the present invention.

SUMMARY OF THE INVENTION

An object of the present invention is to provide a means for predetermining a final location of one or more gaming pieces-prior to the one or more gaming pieces being put in motion.

Another object of the present invention is to provide a primary or secondary gaming machine that allows the programming of exact, indisputable and repeatable predefined win/loss percentage outcomes.

Another object of the present invention is to provide a predetermined game outcome that appears random to a player.

Another object of the present invention is to provide game recall in order to resolve potential and ordinary disputes by indicating the results of a predetermined number of games as well as the ability to physically recreate the previous game.

Yet another object of the present invention is to provide a means for tracking the game pieces to insure that they are traveling according to a predetermined path or paths; or arriving at a predetermined location; or to evaluate tilt conditions.

Accordingly, a preferred embodiment of the present invention consists of a generally flat and vertical game surface having a plurality of hollow barriers extending therefrom. Each barrier can be polarized by introducing a magnet into a space defined by the barrier. The game surface is enclosed to prevent a magnetic game piece from exiting the gaming area. Moreover, the enclosure defines a space of nominal size above the game surface—such as an ant farm—to prevent the magnetic game piece from flipping over. A series of slots are arranged at the bottom, sides or other exits of the game surface and function to catch the game piece as its departs from the field of magnetic and non-magnetic barriers. A player is awarded depending on the preassigned value of the slot into which the game piece lands.

The polarity of the magnetic game piece and the magnets used to polarize the barriers must be the same to insure that the game piece is controlled by the repulsive effects of the now magnetic barriers. Both the magnetic game piece and magnetic barriers are preferably flat isotropic discs or rings which prevent the disc or rings from flipping over during motion. Thus, by strategically creating magnetic barriers about the gaming surface, an operator can insure that the magnetic game piece traverses a predefined path, or arrives at a predefined location, while appearing to follow a random path. In this manner, accurate game odds can be calculated or created so that a game implementing the present invention may be regulated by gaming bodies and therefore attractive to casinos. The game may be implemented as a primary game or secondary game.

The magnetic barriers are created by extending a magnet from behind the game surface into the space defined by the barrier. On the other hand, the magnet may be set flush with the game surface thereby eliminating its effect on the magnetic game piece. In a preferred method, the magnets are extended and retracted, with respect to the game surface, by means of a linear motor concealed behind the game surface.

The present invention may be used to create an unlimited number of "plurality of pins" games as well as other traversal "start-at-X" and "end-at-Y" games. For example, the created magnetic barriers and non-magnetic barriers can be arranged in a pinball fashion. In any arrangement, the final position of the magnetic game piece is predetermined such that an operator knows where the game piece will land and what award, if any, the player will receive.

Means for confirming that the magnets have been raised to create magnetic barriers and to track the game piece includes multiple Hall-effect sensors arranged adjacent each magnet within each barrier. Such tracking means provide operators with confirmation of game integrity and may also be used to trigger ancillary game events such as passing lights, pinball type bumper and pinball type flippers.

DETAILED DESCRIPTION OF THE INVENTION

Figure 1:
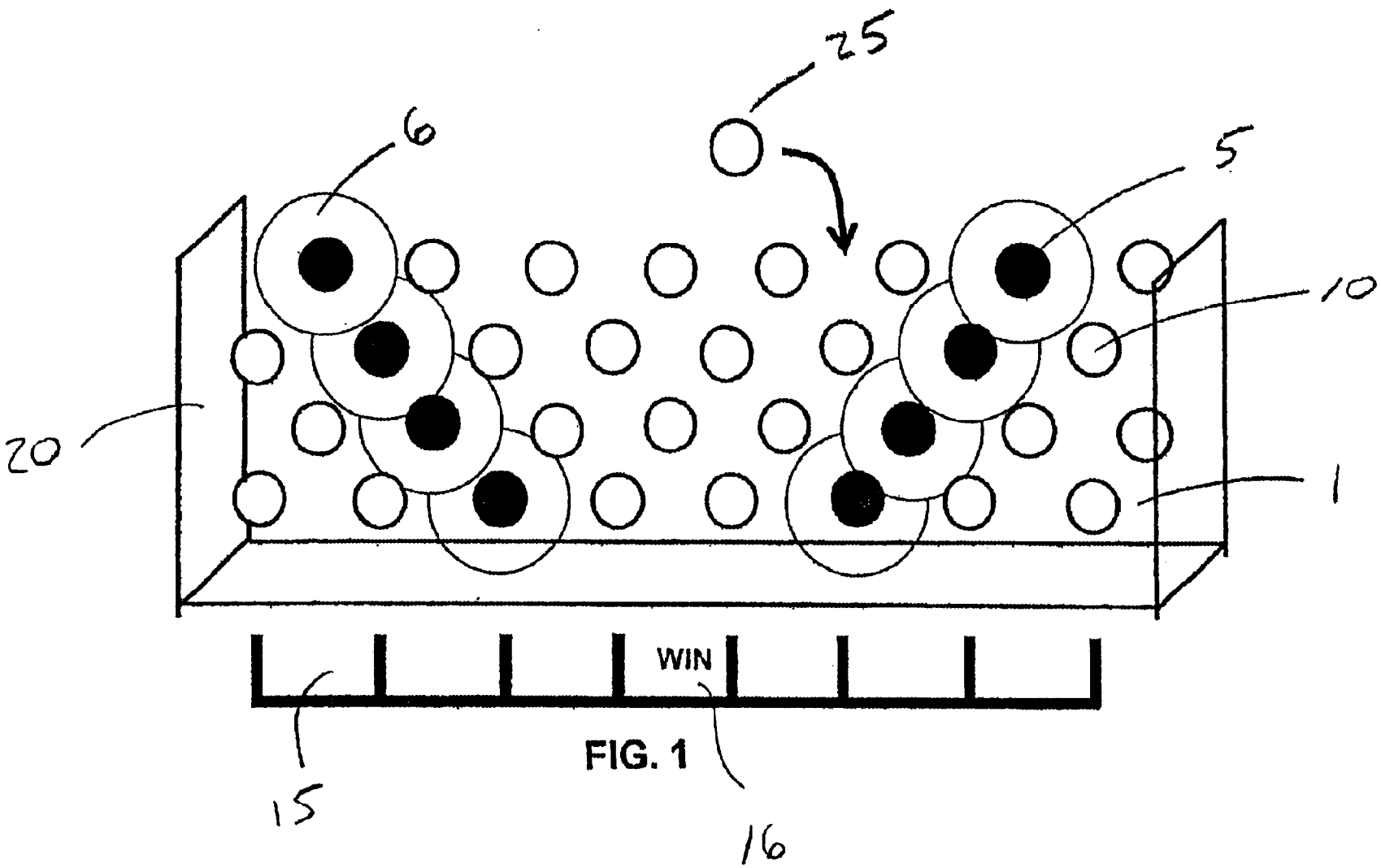
FIG. 1 shows a pachinko-like game surface utilizing the present invention.
Figure 4:
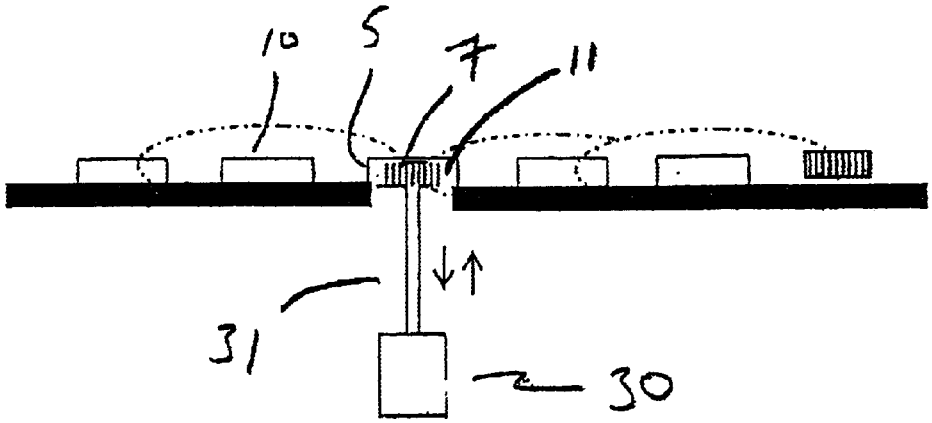
FIG. 4 shows cross-sectional view of a game surface of the present invention

Reference is now made to the figures wherein like parts are referred to by like numerals throughout. FIG. 1 shows a game surface 1 having a plurality of hollow barriers which are either magnetic barriers 5 or non-magnetic barriers 10. In addition, the game surface 1 includes slots 15 and side walls 20. The magnetic barriers 5 are illustrated in black with hypothetical magnetic fields 6 emanating therefrom. A magnetic game piece 25 having an opposite polarity to the magnetic barriers 5 is shown near a top of the game surface 1. The magnetic fields 6 of the magnetic barriers 5 create an invisible channel such that the game piece 25 must land in slot 16 identified as a winning slot. Although the magnetic barriers 5 are shown in black, in practice, a player is unable to discern the difference between magnetic barriers 5 and non-magnetic barriers 10 since integral magnets 7 (shown in FIG. 4) are concealed by each identical looking barrier. Therefore, the manner in which the game piece 25 traverses the field of magnetic barriers 5 and non-magnetic barriers 10 appears to be random. FIG. 4 shows in detail the method and device used to create and eliminate magnetic barriers 5.

Both the magnets 7 and the magnetic game pieces 25 are disk-like in shape to facilitate control of the game piece 25. Additionally, disk-like magnetic devices create a magnetic field 6 in a 360° range. Even though the particular size of the magnets 7 is not critical to the present invention, it is suggested that one inch diameter magnets are beneficial since they are commercially available at low cost and facilitate barriers of an eye-pleasing size.

Figure 2:
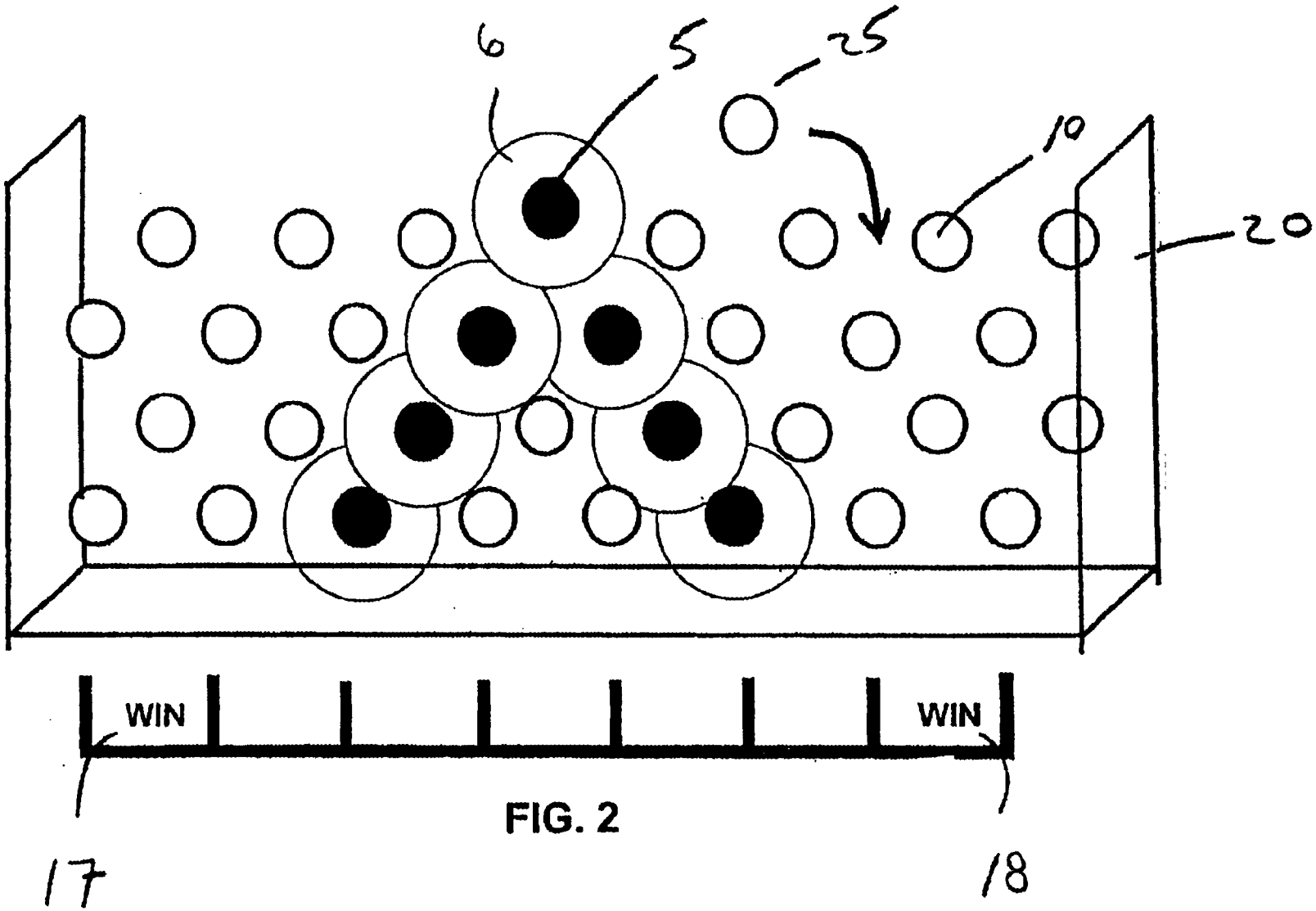
FIG. 2 shows an alternative pachinko-like game surface utilizing the present invention.

A transparent game surface cover (not shown) prevents the game piece 25 from exiting the game area. The cover is sufficiently near the game surface 1 to further prevent the magnetic game piece 25 from flipping over and interrupting the interaction between the magnetic barriers 5 and the magnetic game piece 25. FIG. 2 shows an alternative embodiment whereby the game piece 25 follows one of two paths to either slot 17 or slot 18 identified as winning slots. Any number of predetermined paths can be created to guarantee a true sense of randomness for players. Moreover, while only one game piece 25 is shown, multiple simultaneously played game pieces may be utilized.

Figure 3:
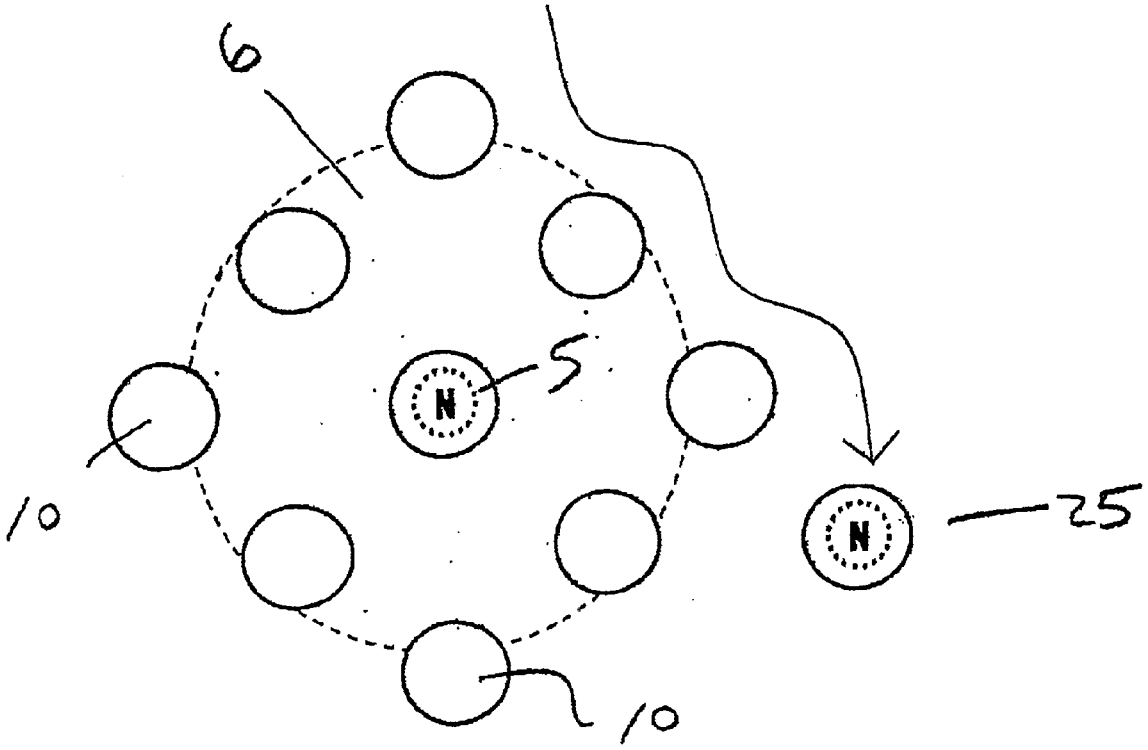
FIG. 3 shows a single magnetic game barrier and its field of strength.

FIG. 3 shows a more detailed top view of a single magnetic barrier 5 and its corresponding magnetic field 6. A plurality of non-magnetic barriers 10 surround the magnetic barrier 5 in a generally circular arrangement. A game piece 25 may collide with any number of the non-magnetic barriers 10, but the magnetic field 6 of the magnetic barrier 5 prevents the game piece 25 from passing into the circular area defined by the plurality of non-magnetic barriers 10. This particular arrangement, and unlimited others, facilitate the appearance of randomness.

Now referring to FIG. 4, a cross-sectional view along the game surface 1 shows a linear motor 30 arranged to drive an elongated arm 31 that is joined to an under-side of a magnet 7. The linear motor 30 allows the magnet 7 to be raised into a cavity 11 of the barrier 5 thereby forming a magnetic barrier 5. Similarly, the magnet 7 may be lowered to create the opposite effect. Each of the barriers of the game surface 1 may include an identical arrangement allowing an unlimited number of paths to be created. In all instances, the operator will know, prior to placing the game piece 25 into the field of barriers, which slot or possible slots will catch the game piece 25.

The magnets 7 and the game piece 25 are preferably samarium cobalt or neodymium having strengths in the range of 9,000 to 12,000 gauss. It has been determined that a gauss range of 9,000 to 12,000 is ideal to provide the appearance of randomness. Weaker and/or stronger magnets may also be used dependent on the spacing of the barriers. The spacing of the barriers, particularly the magnetic barriers 5, must allow the game piece 25 to pass through the predetermined pathways without being stopped or impeded by a magnetic eddie. Experimentation with neodymium magnets of varying size indicates that a disk-like magnet diameter to spacing should be approximately 0.4 to maximize the effectiveness of the movement of the game piece 25.

Figure 5:
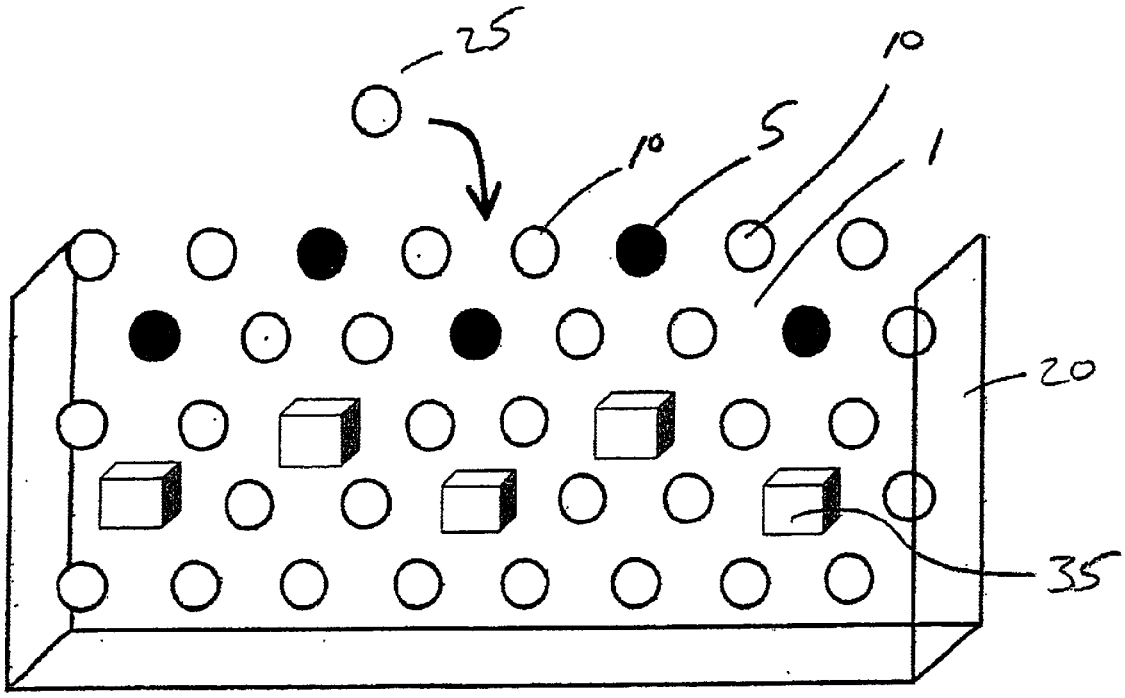
FIG. 5 shows a second alternative pachinko-like game surface utilizing the present invention.

FIG. 5 illustrates a second alternative version of a game surface 1 of the present invention. This configuration eliminates the slots 15 (shown in FIGS. 1 and 2) and replaces them with cups 35 spaced throughout the plurality of barriers. Should the game piece 25 land in a cup 35, a player wins a predetermined award. Again, one or more of the barriers are filled with a magnet 7 to invisibly direct the game piece 25 into one of the cups 35. In an alternate version, the cups 35 may be used in conjunction with the slots 15 shown in FIGS. 1 and 2.

Figure 6:
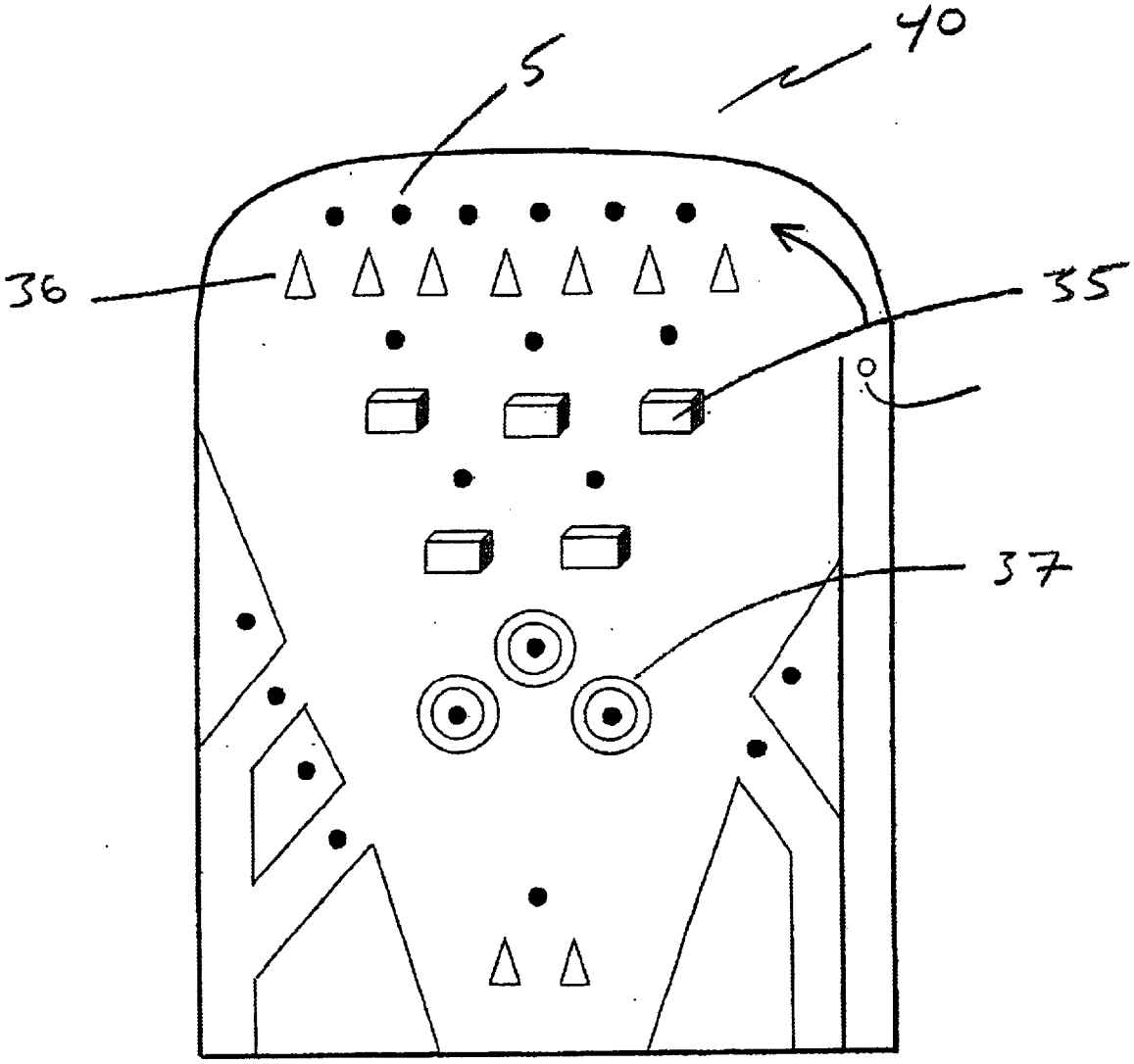
FIG. 6 shows a third alternative pachinko-like game surface.

Now referring to FIG. 6, a pinball-style pachinko arrangement generally denoted by reference numeral 40 is shown utilizing the present invention. In such a design, a game piece 25 is propelled into a field of barriers, including cups 35, triangular deflectors 36 and circular deflectors 37. A limitless number of shapes and sizes of deflectors and barriers are available. Again, the important aspect is the ability of an operator to invisibly control the direction of the game piece 25.

Figure 7:
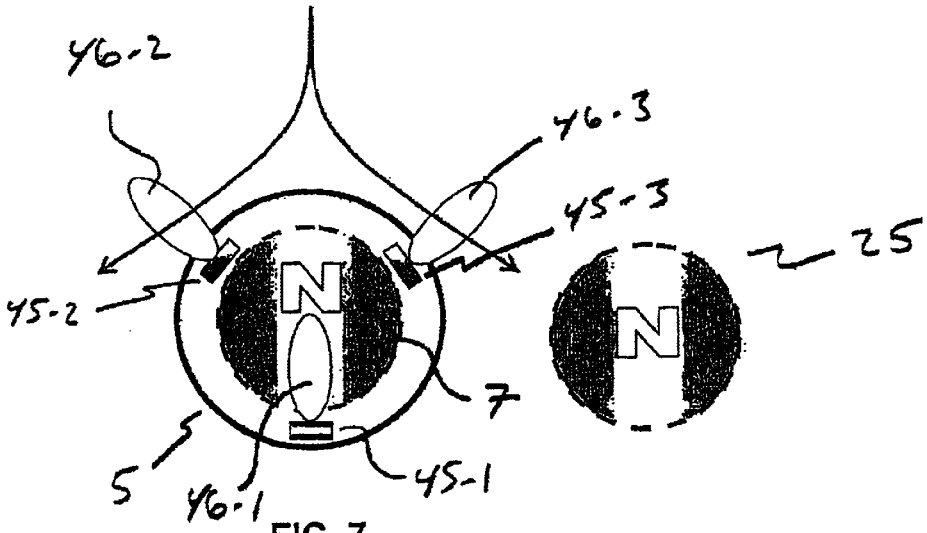
FIG. 7 shows a top view of a magnetic barrier having multiple sensor devices arranged adjacent thereto.
Figure 8:
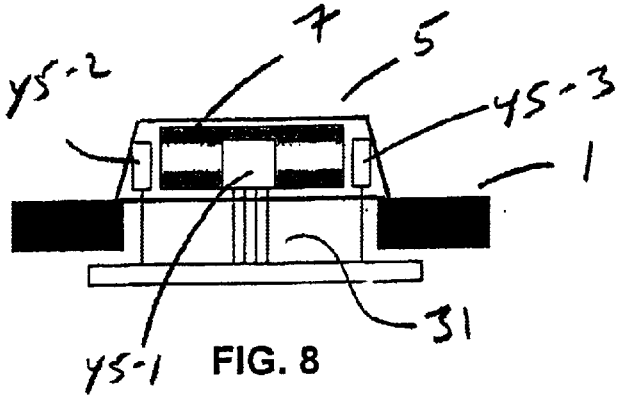
FIG. 8 shows a side view of the magnetic barrier having multiple sensor devices arranged adjacent thereto.

FIG. 7 shows a top view of a sensing system for tracking the path of a game piece 25. Based on the tracked path, the sensing system can trigger certain events and provide a means for verifying the integrity of the game. Three sensors 45-1, 45-2, 45-3 are radially spaced adjacent each magnet 7 and within a barrier. The sensors 45-1, 45-2, 45-3 are preferably Hall-effect sensors of the kind manufactured by Allegro Microdevices and having part number UQK5140K. Hall-effect sensors are integrated circuits designed to detect magnetic fields. As such devices are known in the art, their operation is not discussed in great detail herein. The three sensors 45-1, 45-2, 45-3 are arranged so that sensor 45-1 is used to detect the position of magnet 7 while the two remaining sensors 45-2, 45-3 detect the passage of the magnetic game piece 25. Hall-effect sensors sense magnetic fields in a particular direction as indicated by sensor areas 46-1, 46-2, 46-3 corresponding to the sensors 45-1, 45-2, 45-3. Therefore, once magnet 7 is raised into barrier 5, it interrupts the sensing area 46-1 such that sensor 45-1 senses its presence. In a similar fashion, sensor areas 46-2, 46-3 face outwardly and substantially oppositely from the barrier 5 and detect the passage of the game piece 25 on either side of the barrier 5. FIG. 8 shows a side view of the arrangement of FIG. 7. While Hall-effect sensors have been described herein, other sensors including those utilizing light beams or similar frequency-based waves could be used to accomplish the same objective.

The sensors 45-1, 45-2, 45-3 may be used to trigger lights or other game effects as the game piece 25 passes each barrier. The sensors 45-1, 45-2, 45-3 may also alert the operator of the position (e.g. raised or lowered) of each magnet 7 thereby insuring that the game piece 25 follows a prescribed path. Should a particular magnet 7 not be in the correct position the operator can investigate to determine whether the linear motor 30, or other game part, is in need of repair or to determine whether a player may be altering the path of the magnetic game piece 25. Everyday casino safeguards guarantee that players will not cheat games utilizing the present invention.

It is also possible to utilize the detection of the magnetic game piece 25 to trigger other magnets 7 on the game surface 1 to raise and lower so that the game piece is directed properly. In other words, barriers located near the top of the game surface 1 may be pre-activated while lower located barriers are dependent on the detection of the game piece 25 as it traverses the upper portion of the game surface.

Although the invention has been described in detail with reference to a preferred embodiment, additional variations and modifications exist within the scope and spirit of the invention as described and defined in the following claims.

I claim:

1. A game having random appearing outcomes comprising:

a game board having an upper section and a lower section, said game board having a plurality of barriers spaced thereupon;

one or more of said barriers able to conceal a magnet, said magnets being adjustable from an upper position within the barriers to a lower position beneath said game board; and a magnetic game piece, for traversing said game board, having a magnetic charge the same as any concealed barrier magnets.

2. The game of claim 1 wherein said game piece is generally disc shaped.

3. The game of claim 2 wherein a transparent member is spaced above said game board a sufficient distance for preventing said game piece from flipping over.

4. The game of claim 2 wherein a ratio of a diameter of said game piece to spacing between said barriers concealing magnets is within a range of 0.3 to 0.5.

5. The game of claim 1 wherein said magnets are adjusted by means of linear actuators connected to said barrier magnets.

6. The game of claim 1 wherein magnetic field sensors located adjacent said barriers sense the position of the barrier magnets.

7. The game of claim 1 wherein magnetic field sensors located adjacent said barriers sense the passage of said game piece.

8. The game of claim 7 wherein upon said magnetic field sensors sensing the passage of said game piece cause activation of ornamental game features including lights and bells.

9. The game of claim 1 wherein said game board includes a plurality of defined positions at the lower section.

10. The game of claim 9 wherein said defined positions correspond to multiple point levels.

11. The game of claim 1 wherein said game piece traverses said game board along one or more at least partially predetermined invisible paths influenced by said adjustment of said barrier magnets.

12. The game of claim 1 wherein a transparent cover member is spaced above said game board a sufficient distance to prevent interaction from external magnetic influences.

13. The game of claim 1 wherein said barriers are arranged to play a game corresponding to one game of the group consisting of pachinko, bingo, shuffleboard, billiards, pinball, coin toss and maze.

14. A method of playing a game having random appearing outcomes comprising the steps of:

arranging a plurality of barriers concealing magnets upon a vertically oriented game board such that the said barrier magnets form one or more invisible paths; and introducing said magnetized game piece, having a magnetic charge the same as said barrier magnets, onto said game board for traversing said one or more paths.

15. The method of claim 14 wherein said game piece is generally disc shaped.

16. The method of claim 15 wherein a transparent member is spaced above said game board a distance sufficient to prevent said game piece from flipping over.

17. The method of claim 15 wherein a ratio of a diameter of said game piece to spacing between said barriers concealing magnets is within a range of 0.3 to 0.5.

18. The method of claim 14 wherein said barrier magnets are adjustable from an upper position within the barriers to a lower position beneath said game board.

19. The method of claim 14 wherein said magnets are adjusted by means of linear actuators connected to said barrier magnets.

20. The method of claim 14 wherein magnetic field sensors located adjacent said barriers sense the position of the barrier magnets.

21. The method of claim 14 wherein magnetic field sensors located adjacent said barriers sense the passage of said game piece.

22. The method of claim 21 wherein upon said magnetic field sensors sensing passage of said game piece cause activation of ornamental game features including lights and bells.

23. The method of claim 14 wherein said game board includes a plurality of defined positions for receipt of said game piece.

24. The method of claim 23 wherein said defined positions correspond to multiple point levels.

25. The method of claim 14 wherein said game piece traverses said game board along said one or more invisible paths influenced by said arrangement of said barrier magnets.

26. The method of claim 14 wherein a transparent member is spaced above said game board a sufficient distance to prevent interaction from external magnetic influences.

27. The method of claim 14 wherein said barriers are arranged to play a game corresponding to one game of the group consisting of pachinko, bingo, shuffleboard, billiards, pinball, coin toss and maze.

28. A gaming machine comprising:

a playing surface having a plurality of spaced obstacles;

a controllable magnet positioned below each spaced obstacle and the playing surface, said magnets capable of being raised into recesses of said obstacles so that said raised magnets create a magnetic field on said playing surface; and one or more magnetic game pieces for traversing said playing surface, said game pieces having a same polarity as the controllable magnets so that the game piece is invisibly guided through the obstacles in a predetermined manner to a predetermined conclusion.

29. The gaming machine of claim 28 wherein said controllable magnets are controlled by means of linear actuators.

30. The gaming machine of claim 28 wherein magnetic field sensors located adjacent said obstacles sense the position of the controllable magnets.

31. The gaming machine of claim 28 wherein magnetic field sensors located adjacent said obstacles sense the passage of said game piece.

32. A method of controlling outcomes of a gaming machine comprising:

spacing a plurality obstacles on a playing surface;

positioning a controllable magnet below each spaced obstacle and the playing surface, manipulating one or more of said magnets into a recess of said obstacles generally above said playing surface to create a magnetic field on said playing surface, said magnetic field forming one or more invisible paths; and providing means for one or more magnetic game pieces to be introduced onto said playing surface, said game pieces having a same polarity as the controllable magnets so that the game piece is invisibly guided along the one or more invisible paths in a predetermined manner to a predetermined conclusion.

33. The method claim 32 wherein positioning said controllable magnets is accomplished by means of linear actuators.

34. The method of claim 32 wherein magnetic field sensors located adjacent said obstacles sense the position of the controllable magnets.

35. The method of claim 32 wherein magnetic field sensors located adjacent said obstacles sense the passage of said game pieces.

* * * * *